United States Patent [19]

Hufford

[11] 4,008,756

[45] Feb. 22, 1977

[54] APPARATUS FOR AIR CONDITIONING EMPLOYING VARIABLE TERMINAL BOX

[75] Inventor: Jerrold L. Hufford, Phoenix, Ariz.

[73] Assignee: Armer Construction Company, Phoenix, Ariz.

[22] Filed: Dec. 17, 1975

[21] Appl. No.: 641,755

[52] U.S. Cl. ..... 165/26; 165/27; 165/40; 165/48

[51] Int. Cl.[2] ..... F25B 29/00

[58] Field of Search ..... 165/2, 14, 26, 27, 28, 165/30, 31, 32, 39, 40, 48, 58

[56] References Cited

UNITED STATES PATENTS

| | | | |
|---|---|---|---|
| 2,522,286 | 9/1950 | Lehane | 165/27 |
| 3,192,724 | 7/1965 | Cummings | 165/40 |
| 3,213,928 | 10/1965 | Anderson | 165/26 |
| 3,465,814 | 9/1969 | Heck | 165/26 |
| 3,656,541 | 4/1972 | Coyle | 165/27 |
| 3,788,386 | 1/1974 | Demaray | 165/27 |
| 3,933,197 | 1/1976 | Zimmer | 165/27 |
| 3,951,205 | 4/1976 | Zilbermann | 165/30 |

*Primary Examiner*—Wendell E. Burns
*Assistant Examiner*—Daniel J. O'Connor
*Attorney, Agent, or Firm*—Warren F. B. Lindsley

[57] ABSTRACT

A heating and air conditioning system and a special variable volume terminal box associated therewith, the system utilizing energy dissipated by the lighting and other building facilities in a controlled manner through the functioning of the variable volume terminal box.

9 Claims, 3 Drawing Figures

APPARATUS FOR AIR CONDITIONING EMPLOYING VARIABLE TERMINAL BOX

BACKGROUND OF THE INVENTION

As the available sources of fuel and energy become more scarce and as energy costs reach ever higher levels there is a growing interest in new sources of energy and also in the conservation and full utilization of the energy now produced.

Of special interest to this invention is the efficient utilization of available energy within a building for control of the temperature in the living areas of the structure. A significant amount of energy enters the building for use in lighting, for example, and a major part of the heat developed by the lighting system is radiated to the air space above the lighting fixtures. From there it passes through the roof and is lost to the outside.

In some areas of the country there is a wide temperature range between daytime and nighttime temperatures, and during certain seasons of the year there is often a need for heating during the night and for cooling during the day. As a general rule, heat generated during the day by lighting fixtures and other heat generating equipment is eliminated by the air conditioning system and additional energy purchased from the public utilities is required for heating during the night. The waste and inefficiency of such a system is obvious and demanding of correction.

In the present climate of expensive energy in increasingly short supply there is, therefore, an important need for improved heating and air conditioning systems which more fully utilize the available energy.

SUMMARY OF THE INVENTION

In accordance with the invention claimed, an improved heating and air conditioning system and associated equipment are provided which utilize heat losses from other building facilities as well as heat collected from the sun for the heating of the temperature controlled areas.

It is, therefore, one object of this invention to provide an improved air conditioning system.

Another object of this invention is to provide such an improved air conditioning system which utilizes the heat dissipated by other building facilities including the lighting system as a source of energy for heating the building.

A further object of this invention is to provide such a system which utilizes solar energy absorbed during the warmer periods of the day as an energy source for heating during the colder periods of the day.

A still further object of this invention is to provide such a system wherein either warm air from the attic or other heat storage area or cooled air from the air conditioning unit is directed as appropriate into the temperature controlled areas.

A still further object of this invention is to provide in such a system a means for supplementing the stored heat energy as necessary to maintain the desired space temperature.

A still further object of this invention is to provide as a part of such a system a variable volume terminal box which controls and directs the flow of air through the heat storage area or from the air conditioning unit to the temperature controlled area.

A still further object of this invention is to provide in such a variable volume terminal box the necessary means for controlling the various essential functions including maximum air flow from the air conditioning system operation of the fan drawing air from the heat storage area and control of the supplementary heating unit.

Yet another object of this invention is to provide in conjunction with the variable volume terminal box means for protecting against any possible malfunctions of the equipment which might otherwise constitute a fire or safety hazard.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing, in which.

DESCRIPTION OF THE PREFERRED EMBODIMENT

Figure 1:
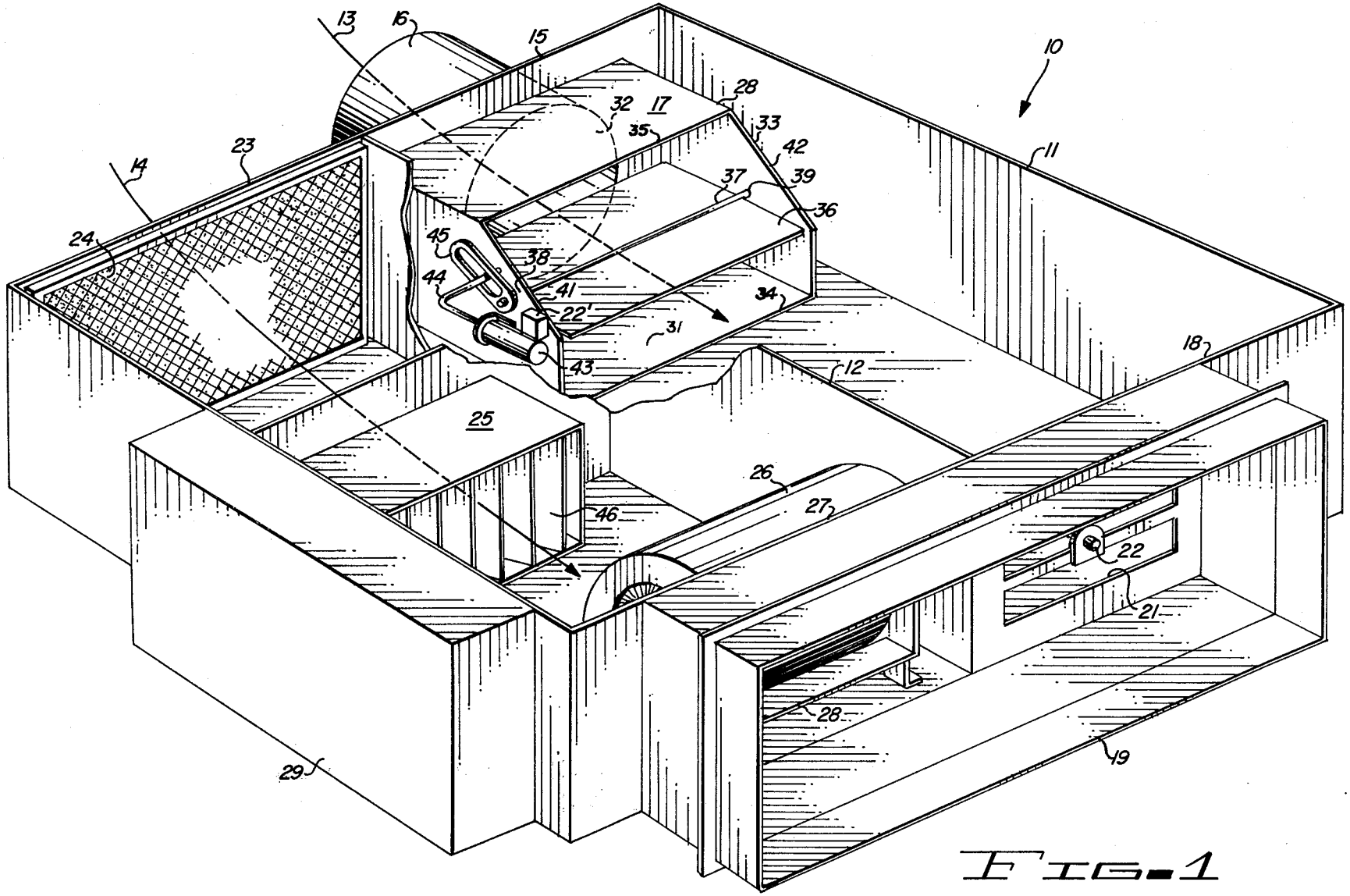
FIG. 1 is a perspective view of the variable volume terminal box of the invention with the top cover removed.

Referring more particularly to the drawing by characters of reference, FIG. 1 discloses a variable volume terminal box 10 contained in a rectangular housing 11 having a length approximately equal to its width and a height being approximately one fourth the width. The box 10 is divided approximately in half lengthwise by a vertical partition 12 so that two parallel air flow channels are formed including a cooling channel 13 and a heating channel 14.

The cooling channel 13 is provided at its intake end 15 with a connecting collar 16 which leads into an air valve 17. The discharge end 18 opens into a discharge plenum 19 through a rectangular opening 21 at the center of which is mounted an air flow sensor 22.

The heating channel 14 is provided at its inlet end 23 with an air filter 24, and it houses midway lengthwise an electric heater unit 25. A squirrel cage blower 26 is located at its outlet end 27, the blower 26 exhausting through a rectangular opening 28 in end 18 into the discharge plenum 19 which is common to both channels 13 and 14.

Attached to the outside of the heating channel 14 is a control box 29 which houses various pneumatic and electric control devices for the operation of valve 17, heater unit 25 and blower 26.

Valve 17 is provided with a shroud 31 in the general form of a truncated cube having a circular opening 32 at one end opening into the inside end of connecting collar 16. The truncation of shroud 31 forms an inclined rectangular opening 33 the lower boundary 34 of which runs horizontally across the lower portion of the end of shroud 31 opposite the opening 32. The upper boundary 35 of shroud 31 runs parallel to the lower boundary 34 across the top of shroud 31.

A rectangular vane of damper 36 having outer dimensions only slightly less than those of opening 33 is pivotally mounted within opening 33 by means of a pivot rod 37 which is attached to damper 36 along its horizontal center line. The ends of rod 37 extend beyond the edges of damper 36 and are journaled within holes 38 and 39 located near the edges of opening 33. Hole 38 is located near the center of one inclined edge 42. Thus, damper 36 may be rotated about rod 37 from a horizontal position, in which it offers essentially no resistance to air flow through valve 17 to an inclined position aligned with opening 33 where it may block air flow through channel 13.

The rotational control of damper 36 is accomplished by means of pneumatic motor 43 which is mounted inside of channel 14 on the side of partition 12 opposite vane 36. Motor 43 is a plunger type motor having a substantially cylindrical shape with its axial plunger 44 extending outwardly thereof and then laterally thereof, as shown, into the slotted end of a lever arm 45. Lever arm 45 is attached laterally thereof to the end of rod 37. The slotted opening of arm 45 is engaged by the lateral extension of plunger 44. As plunger 44 is extended or retracted from the housing of motor 43, arm 45 and damper 36 are rotated about pivot rod 37 as desired for the control of air flow through valve 17.

The air flow sensor 22 is a limit detecting device which is employed to control motor 43 and valve 22'. It is only activated when air flow through channel 13 exceeds a set level.

Air filter 24 may be any one of a number of commercially available types formed of suitable material such as fiberglass.

Figure 2:
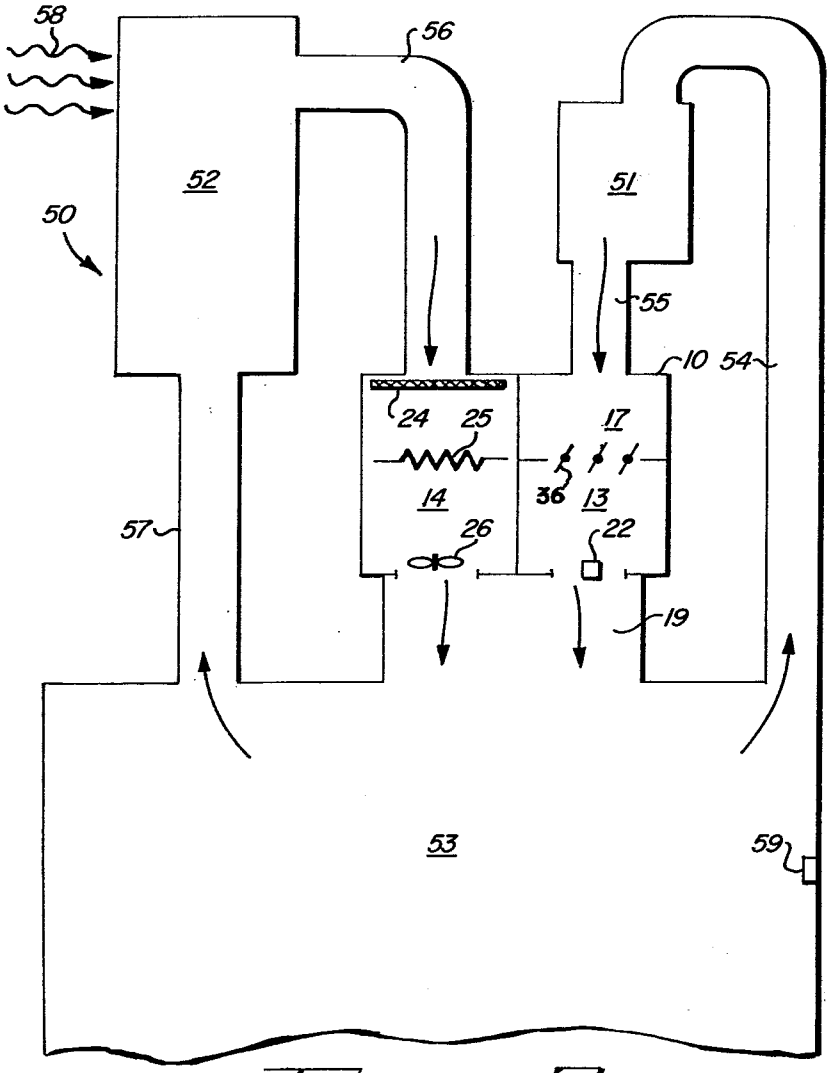
FIG. 2 is a diagrammatic representation of the heating and air conditioning system of the invention.

Heater 25 is simply a metal housing with openings 46 front and rear to allow the passage of air therethrough and employs an internal resistance heating element diagrammatically shown in FIG. 2 which is electrically energized when it is desired to supplement the heat content of the air flowing through channel 14.

While blower 26 is described and illustrated as a squirrel cage type, the use of other types of fans or blowers may be employed.

The functional diagram of FIG. 2 illustrates an embodiment of the improved heating and air conditioning system 50 of the invention incorporating the variable volume terminal box 10. The system 50 comprises in addition to terminal box 10 an air conditioning unit 51 and a heat collection and storage chamber 52 interconnected with a living, working or other space 53 in which temperature is to be controlled. Interconnecting these major elements or the system 50 are air handling pipes or ducts 54–57 and the plenum 19.

Chamber 52 may be any space in which heat tends to accumulate such as an air space above a false ceiling in which lighting fixtures are installed or an attic which collects heat from the sun. In some cases chamber 52 may be designed into a new building with the specific intention of accommodating the system 50 of this invention. In any case, chamber 52 holds a volume of air which receives heat energy 58 from some energy source other than that produced directly as a heat source by public utilities through the combustion of fuels.

As shown in FIG. 2, system 10 incorporates two air flow circulation loops with the first loop beginning at air conditioning unit 51 and continuing through pipe 55, chamber 13 and plenum 19 into space 53, then returning to air conditioning unit 51 via pipe 54. The second loop begins at chamber 52 and continues through pipe 56, chamber 14, plenum 19 and into space 53 and thence through pipe 57 back into chamber 52.

It should be noted that system 50 has two operating modes including a cooling mode and a heating mode.

In the cooling mode, blower 26 is not energized so that no air is drawn from chamber 52 through channel 14. A thermostat 59 monitors the temperature in space 53 and controls valve 17 as appropriate to regulate the air flow from air conditioning unit 51 thus regulating the temperature of space 53. The air flow sensor 22 comes into operation only if the air flow through channel 13 exceeds a set amount and is particularly essential to the operation of a system in which there are more than one terminal box incorporated with each box utilized to control a separate space 53 and drawing cooled air from a single air conditioning unit 51. In such an application sensor 22 prevents excessive air flow to any one space which would constitute a cause for discomfort in that space as well as an excessive load on the air conditioning unit which might reduce the effectiveness of system 10 in adequately providing the cooling requirements of other areas.

As the temperature in space 53 falls below a predetermined level valve 17 is closed and blower 26 is energized to draw warm air from chamber 52 through channel 14. If the air from chamber 52 is not warm enough to hold the temperature in space 53 above a set lower limit, heater unit 25 is energized to introduce the additional required heat energy. Because heater unit 25 is only utilized when the "free" heat energy 58 proves inadequate, a saving in energy and heating costs is achieved in accordance with a primary object of the invention.

Figure 3:
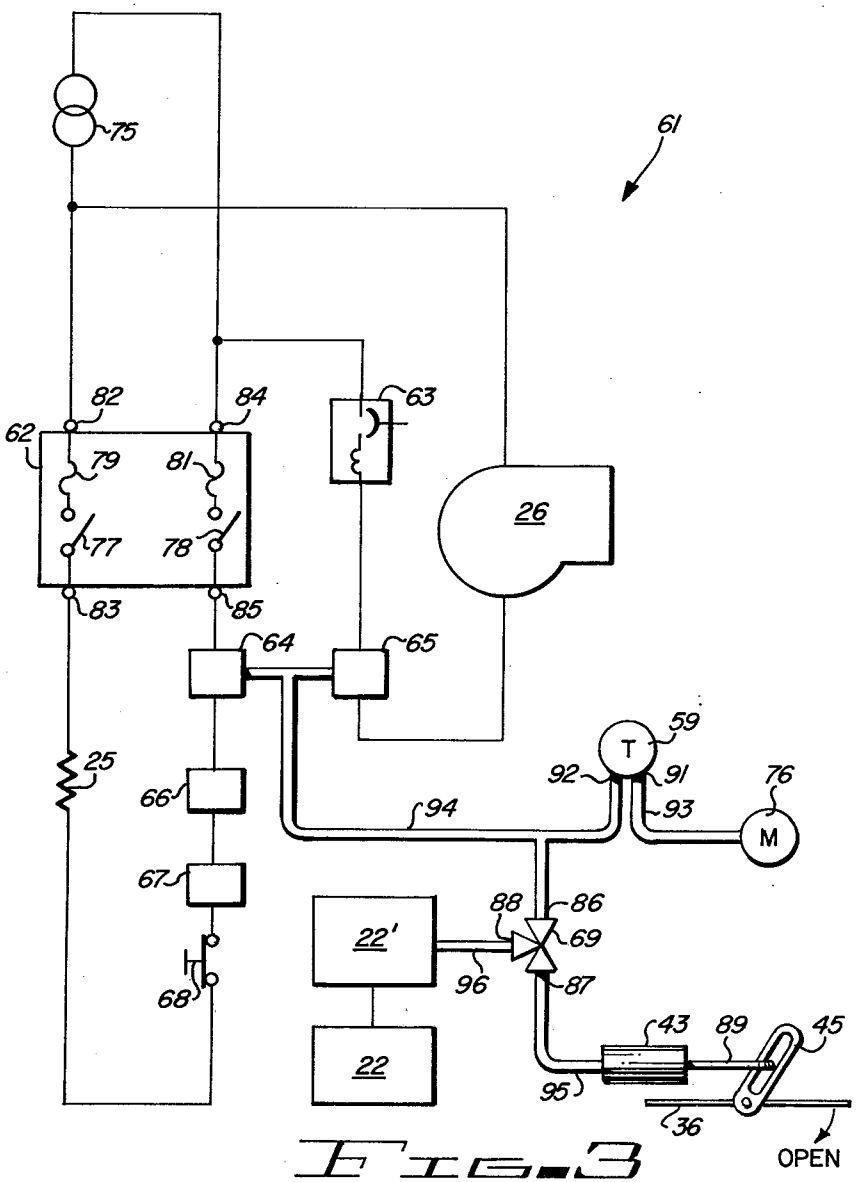
FIG. 3 is a schematic diagram showing the arrangement of the electric and pneumatic control elements incorporated in the variable volume terminal box.

The control of system 50 to effect the operating modes just described is accomplished by control system 61 of FIG. 3. Control system 61 incorporates some elements already mentioned and shown in FIGS. 1 or 2 including fan 26, thermostat 59, air flow sensor 22, motor 43, lever arm 45, damper 36 and heater unit 25. Additionally, it includes a fused disconnect 62, a fan disconnect 63, pneumatic electric switches 64 and 65, an air flow switch 66, an automatic thermal cutout 67, a manual reset thermal cutout 68, and a pneumatic restrictor 69. The control system 61 receives electric energy from a source of alternating current voltage 75 which is typically 120 volts at 60 hertz; it is also energized pneumatically from a source of air pressure 76.

Disconnect 62 comprises two manually operated contacts 77 and 78 and two fuses 79 and 81 with fuse 79 and contact 77 serially connected between a first line terminal 82 and a first load terminal 83. Fuse 81 and contact 78 are serially connected between a second line terminal 84 and a second load terminal 85. Fan disconnect 73 is a circuit breaker which is opened by excessive current and which may also be opened or closed manually.

Air flow switch 66 is any one of a variety of switches designed to close when placed in an air stream of a given minimum velocity. If the air velocity falls below the minimum level the switch 66 opens.

The thermal cutout 67 may be automatic or manual and opens when it senses a temperature above a given high level and recloses automatically if the temperature subsequently falls below a second lower level.

The manual reset thermal cutout 68 opens automatically if a given temperature is exceeded. It remains open until it is reset manually.

Thermostat 59 is a pneumatic type which is connected in series with an air pressure line. It responds to temperature changes about a set level by producing a pressure drop or a pressure rise in the pneumatic line.

Disconnect 63 is a manually operated switch controlling voltage to blower 26.

Pneumatic-electric switches 64 and 65 have electric contacts which are opened or closed by pressure in a connected pneumatic control line. As pressure falls below a predetermined level, the switch closes, the level at which the closing occurs being determined by an adjustment of the switch.

Restrictor 69 has three ports 86, 87 and 88. A pressure drop exists between ports 86 and 87 and this pressure drop increases as air is bled off through port 88 so that as an increasing amount of air is bled off through port 88 the pressure at port 87 becomes lower and lower.

Air flow sensor 22 operates an air flow operated valve 22' which when air flow exceeds a predetermined level opens valve 22' bleeding off air from the pneumatic line.

Damper motor 43 is operated by pneumatic pressure and as the pressure increases the axial plunger 89 of motor 43 extends; as pressure decreases plunger 89 is withdrawn inside the body of motor 43.

As shown in FIG. 3, heater unit 25 is serially connected with fuse 79, contact 77, cutout 68, cutout 67, switch 66, switch 64, contact 78 and fuse 81 across source 75. Cutout 62 serves as a means for manually disconnecting heater unit 25 and provides fuse protection against electrical shorts or failures. Air flow switch 66 opens if air flow through heater unit 25 is interrupted and thereby prevents damage to unit 25 by overheating. Cutouts 67 and 68 are redundant protective devices which are opened by excessive current. They are incorporated as safety features and are required to meet safety codes. Switch 64 automatically controls the energization of heater unit 25 and is operated by thermostat 59.

Blower 26 is serially connected with cutout 63 and switch 65 across source 75. Disconnect 63 serves as a means for manually disconnecting blower 26 from source 75 and switch 65 serves as a means by which blower 26 is automatically energized through the control of thermostat 59.

Thermostat 59 has an input port 91 and an output port 92. Input port 91 is connected by pneumatic line 93 to pressure source 76; output port 92 is connected by pneumatic line 94 to switches 64 and 65 and to port 86 of restrictor 69. Port 87 of restrictor 69 is connected by pneumatic line 95 to damper motor 43, and port 88 is connected by line 96 to sensor 22.

Operation

Operation of systems 50 and 61 occurs as follows:

Assuming that the temperature in space 53 is such that thermostat 59 calls for cooling and the pressure in line 94 is sufficiently high that switches 64 and 65 are held open so that heater unit 62 and blower 26 are not energized. There is therefore no air flow through heating channel 14. The same relatively high pressure in line 95 causes damper motor 43 to extend plunger 89 and thereby to hold damper 36 in a relatively open position so that cooling air from the air conditioning unit is admitted through channel 13 into space 53 with warm air recirculating through duct 54 to unit 51.

As the temperature in space 53 begins to fall, thermostat 59 responds by reducing the pressure in line 94. A corresponding reduction in pressure is transmitted through restrictor 69 and line 95 to motor 43. The reduced pressure to motor 43 causes plunger 89 to be retracted somewhat and damper 36 to be moved closer to a closed position so that a reduction in cooling air through channel 13 is effected as appropriate to regulate the temperature in space 53.

Under certain conditions, a very high cooling demand as evidenced by a high temperature in space 53 will call for a high rate of air flow through channel 13, but such a high rate of flow will cause creature discomfort in space 53 and may adversely affect the performance of other cooling channels connected to unit 10 (not shown in FIG. 2). When air flow through channel 13 exceeds the desired maximum level sensor 22 opens causing air to be bled off at port 88 of restrictor 69. The attendant reduction in pressure at port 87 and line 95 causes plunger 89 of motor 43 to be withdrawn so that damper 36 is moved toward a closed position only to the degree necessary to limit air flow to the desired maximum level.

A drop in outside temperature as might be experienced, for example, during the late evening, will remove the requirement for cooling. The reduced temperature in space 53 as sensed by thermostat 59 results in a significant drop in pressure in line 94. The reduced pressure in line 94 causes switch 65 to close energizing blower 26 just prior to the complete closing of damper 36 so that the total interruption of air flow in space 53 is prevented, but the source of air flow is now chamber 52 with its charge of warm air which had received thermal energy 58 during the warmer part of the day as from the sun or from the building lighting system.

The warm air from chamber 52 now warms space 53 as air is circulated from chamber 52 through duct 56, and channel 14 into space 53 and returning through duct 57 to chamber 52. As the outside temperature continues to fall, however, this source of heat becomes inadequate and thermostat 59, sensing a still lower temperature in space 53 causes a still lower pressure in line 94 which causes switch 64 to close, thereby energizing heater unit 25. Unit 25 is then cycled on and off by thermostat 59 and switch 64 as appropriate to regulate the temperature in space 53 during the ensuing heating cycle.

A complete and effective heating and cooling system is thus provided in accordance with the stated objects of the invention wherein the variable volume terminal box permits the controlled utilization of collected thermal energy from the sun and the lighting system as a first source of heating energy with provision as well for supplementing the first source by means of utility supplied electrical energy.

It will be appreciated that the system may be readily modified to utilize in a similar manner a natural source of cool air in a controlled cooling cycle. In the arid regions of the Southwest, for example, cool air can be drawn into a basement area during the night and utilized for cooling a living area during the day. A rearrangement of the control system 61 would be required to implement such a variation, but similar principles and control arrangements would be utilized.

Although but a single embodiment of the invention has been illustrated and described, it will be apparent to those skilled in the art that various changes and modifications may be made therein without departing from the spirit of the invention or from the scope of the appended claims.

What is claimed is:

1. A variable volume terminal box, said box comprising first and second air flow channels, each of said channels being isolated from the other and each comprising an input port and an output port, said input port of said first channel being connectable to a source of cool air under pressure and said output port of said first channel being connectable to a plenum opening into the enclosure, said input port of said second channel being connectable to a source of heated air and said output port of said second channel being connectable to said plenum, damping means arranged in said first channel for controlling air flow through said first channel, first conduit means for connecting an air space of an enclosure to the source of cool air to provide a first closed air flow passageway, an air flow sensor mounted in said output port of said first channel, a heating element mounted in said second channel, an electric blower mounted in said output port of said second channel, second conduit means for connecting the enclosure to the source of heated air to provide a second closed air flow passageway, first means actuated upon a first predetermined reduction in temperature in the enclosure for actuating said damping means to reduce the flow of air through said first channel and upon a second reduction in temperature energizing said electric blower to cause air flow from the source of heated air through said second channel to the enclosure, and second means for energizing said heating element to heat the air flow through said second channel upon predetermined further drop of temperature in the enclosure.

2. The apparatus set forth in claim 1 wherein:

said first means comprises a pneumatic means.

3. The apparatus set forth in claim 2 wherein:

said second means comprises a pneumatic actuated switch controlled by the air flow through said first passageway.

4. Apparatus for air conditioning an enclosure comprising:

a variable volume terminal box, said box comprising first and second air flow channels, each of said channels being isolated from the other and each comprising an input port and an output port, said input port of said first channel being connectable to a source of cool air under pressure and said output port of said first channel being connectable to a plenum opening into the enclosure, said input port of said second channel being connectable to a source of heated air and said output port of said second channel being connectable to said plenum, damping means arranged in said first channel for controlling air flow through said first channel, first conduit means for connecting the air space of the enclosure to said source of cool air to provide a first closed air flow passageway, an air flow sensor mounted in said output port of said first channel, a heating element mounted in said second channel, an electric blower mounted in said output port of said second channel, second conduit means for connecting the enclosure to said source of heated air to provide a second closed air flow passageway, a thermostat for mounting in the enclosure, means actuated by said thermostat upon a first predetermined reduction in temperature in the enclosure for actuating said damping means to reduce the flow of air through said first channel and upon a second reduction in temperature energizing said electric blower to cause air flow from said source of heated air through said second channel to the enclosure, and means for energizing said heating element to heat the air flow through said second channel upon predetermined further drop of temperature in the enclosure.

5. The apparatus set forth in claim 4 wherein:

said means actuated by said thermostat comprises a pneumatic means.

6. The apparatus set forth in claim 5 wherein:

said means for energizing said heating element comprises a pneumatic actuated switch controlled by the air flow through said first passageway.

7. The apparatus set forth in claim 6 wherein:

said means for energizing said heating element is actuated to complete an electric circuit through said heating element upon a predetermined reduction of air flow through said first passageway.

8. The apparatus set forth in claim 7 wherein:

said source of heated air comprises heat radiated by electric lights used in the enclosure.

9. The apparatus set forth in claim 7 wherein:

said source of heated air comprises solar energy rays absorbed by at least a part of the enclosure.

* * * * *